US006739381B2

(12) United States Patent
Esser et al.

(10) Patent No.: US 6,739,381 B2
(45) Date of Patent: May 25, 2004

(54) METHOD OF PRODUCING A TURBINE BLADE

(75) Inventors: Winfried Esser, Bochum (DE); Michael Haendler, Erkrath (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/117,633

(22) Filed: Apr. 4, 2002

(65) Prior Publication Data

US 2002/0157251 A1 Oct. 31, 2002

(30) Foreign Application Priority Data

Apr. 4, 2001 (EP) ..... 01108480

(51) Int. Cl.[7] ..... B22C 9/04; B22C 9/10; B22D 33/04

(52) U.S. Cl. ..... 164/137; 164/122.1; 164/361; 164/369; 164/516

(58) Field of Search ..... 164/516, 517, 164/518, 519, 137, 122.1, 122.2, 361, 369, 365, 368

(56) References Cited

U.S. PATENT DOCUMENTS

| | | | | | |
|---|---|---|---|---|---|
| 3,761,201 | A | * | 9/1973 | Silvestein et al. | 416/232 |
| 5,111,570 | A | * | 5/1992 | Baumgarten et al. | 29/402.13 |
| 5,407,326 | A | * | 4/1995 | Lardellier | 416/233 |
| 6,370,752 | B1 | * | 4/2002 | Anderson et al. | 29/402.11 |
| 6,516,865 | B1 | * | 2/2003 | Beeck et al. | 164/76.1 |

FOREIGN PATENT DOCUMENTS

| | | | |
|---|---|---|---|
| EP | 1 022 434 | * | 7/2000 |

* cited by examiner

*Primary Examiner*—Kuang Y. Lin

(57) ABSTRACT

In a method of producing a turbine blade in hollow section, an especially low defect or scrap rate is to be ensured. To this end, a first core element is connected via a number of approximately cylindrical spacers to a further core element and/or to a casting mold, the cavities left in the casting mold by the core elements being filled by blade material, and the openings remaining in the turbine blade after the removal of the core elements and the spacers and produced by the spacers being closed by stopper elements.

19 Claims, 2 Drawing Sheets

METHOD OF PRODUCING A TURBINE BLADE

PRIORITY CROSS REFERENCE

This application claims priority to EP/01108480.3, filed Apr. 4, 2001 under the European Patent Convention and which is incorporated by reference herein in its entirety.

FIELD OF THE INVENTION

The invention relates to a method of producing a turbine blade in hollow section.

BACKGROUND OF THE INVENTION

Gas turbines are used in many fields for driving generators or driven machines. In the process, the energy content of a fuel is used for producing a rotational movement of a turbine shaft. To this end, the fuel is burned in a combustion chamber, in the course of which air compressed by a compressor is supplied. In this case, the working medium which is produced in the combustion chamber by the combustion of the fuel and is under high pressure and high temperature is directed via a turbine unit connected downstream of the combustion chambers, where it expands to perform work. In the process, the impulse transfer, required for producing the rotational movement of the turbine shaft, from the working medium is achieved via turbine blades. To this end, a number of profiled moving blades are arranged on the turbine shaft, these moving blades, for directing the flow medium in the turbine unit, being complemented by guide blades connected to the turbine casing. In this arrangement, for suitable guidance of the flow medium, the turbine blades normally have a profiled blade body extended along a blade axis.

To achieve an especially favorable efficiency, such gas turbines, for thermodynamic reasons, are normally designed for especially high outlet temperatures of the working medium flowing out of the combustion chamber and into the turbine unit, these outlet temperatures ranging between about 1200° C. and 1300° C. At such high temperatures, the components of the gas turbine, in particular the turbine blades, are subjected to comparatively high thermal loads. In order to also ensure high reliability and a long service life of the respective components under such operating conditions, the components affected are normally designed to be coolable. In modern gas turbines, therefore, the turbine blades are normally designed as a "hollow section". To this end, the profiled blade body, in its inner region, has cavities (also designated as blade core) in which a cooling medium can be directed. Cooling-medium passages formed in such a way enable cooling medium to be admitted to the regions of the respective blade body which are especially subjected to thermal stress. In this case, an especially favorable cooling effect and thus especially high operating reliability can be achieved by the cooling-medium passages occupying a comparatively large spatial region in the interior of the respective blade body, and by the cooling medium being directed as close as possible to the respective surface exposed to the hot gas. On the other hand, in order to ensure sufficient mechanical stability and loading capacity in such a design, flow may occur in the turbine blade through a plurality of passages, in which case a plurality of cooling-medium passages to which cooling medium can be admitted and which are separated from one another in each case by comparatively thin dividing walls are provided.

Such turbine blades are normally produced by casting. To this end, a casting mold adapted in its contour to the desired blade profile is filled with blade material. To produce the aforesaid blade cores or flow passages for the cooling medium, "core elements" are arranged in the casting mold during the casting, these core elements being removed from the blade body after the casting operation has been effected, so that the cavities desired for the cooling-medium passages are produced. In this case, during the production of a turbine blade having a plurality of the cooling-medium passages separated from one another by dividing walls, a plurality of core elements adapted to the specific shape in each case are arranged in the casting mold. In order to hold these core elements in the correct position during the casting operation, on the one hand relative to one another and on the other hand relative to the casting mold, the core elements are normally connected to one another and/or to the casting mold via spacers. These spacers leave behind undesirable additional cavities when the core elements are removed, and these additional cavities impair the fluidic isolation, actually intended, of the respective core regions from one another and in particular from the outer region of the turbine blade. The spacers are therefore normally designed to be tapered in order to reliably rule out the formation of unacceptably large openings. In this case, the spacers are designed in such a way that, during the casting of the turbine blade, as far as possible a continuous surface or dividing wall which is not completely penetrated by the respective spacer is obtained at the respective location. Nonetheless, the cast turbine blade normally has weak points at the locations of the spacers, these weak points promoting at least local crack formation in the region in question. The defect or scrap rate during the production of the turbine blades is thus comparatively high.

SUMMARY OF THE INVENTION

The object of the invention is therefore to specify a method of producing a turbine blade in hollow section with which an especially low defect or scrap rate can be achieved.

This object is achieved according to the invention by a first core element being connected via a number of approximately cylindrical spacers to a further core element and/or to a casting mold, the cavities left in the casting mold by the core elements being filled by blade material, and the openings remaining in the turbine blade after the removal of the core elements and the spacers and produced by the spacers being closed by stopper elements.

In this case, the invention is based on the idea that a possible cause of defects during the production of the turbine blades can be seen precisely at those weak points which occur as a result of using tapered spacers when connecting the core elements. These weak points on the one hand impair the stability of the blade material at the location in question, but on the other hand can be identified only with difficulty, or cannot be identified at all, during a material test. Thus undiscovered weak points may remain in the material and may subsequently lead, due to crack formation at the location in question, to total failure of the turbine blade.

In order to effectively counteract this, cylindrical spacers are now used instead of conical or tapered spacers. Although these cylindrical spacers also leave behind weak points in the material of the cast turbine blade, these weak points can easily be discovered. While abandoning the principle of keeping the weak points small during the production of the turbine blades, provision is thus made, while tolerating comparatively larger weak points, for the latter to be made such that they can be discovered in an especially simple manner. The weak points, which can thus be reliably discovered, can then be closed effectively and in a manner which does not impair the subsequent operation of the turbine blade, by applying a closure element.

In this case, the spacers are preferably dimensioned in their longitudinal extent in such a way that their ends project beyond the blade profile produced, so that holes which pass completely through the respective structure are always produced during the casting of the turbine blade.

In order to ensure the tightness of the openings left by the spacers even during operation of the turbine blade under comparatively adverse operating conditions, the stopper elements, in an advantageous development, are upset, pressed, or otherwise manipulated after they have been inserted into the respective opening. Such pressing or upsetting ensures that the respective stopper element expands in its width in such a way that it forms an especially intimate positive-locking and frictional connection with the margin of the respective opening. The opening is thus closed in an especially effective manner.

To additionally secure the stopper element in its respective opening, it is advantageously brazed after it has been inserted into the respective opening.

The stopper element used may in each case be a suitable pin-shaped element. However, the stopper elements used are advantageously blind rivets or drive-in pins.

The advantages achieved with the invention consist in particular in the fact that, by deliberately tolerating comparatively large openings in the blade body cast to begin with, each weak point, caused by the spacers, in the blade body can be clearly identified. Concealed weak points are thus reliably avoided. In addition, by the subsequent insertion of the stopper elements, especially effective closure of the respective openings is ensured, so that the turbine blade can be loaded to a particular degree even under comparatively adverse operating conditions. In addition, the spacers may be dimensioned to be comparatively large, so that only a comparatively small number of spacers are required for reliable positioning of the core elements during the casting operation. Thus the number of openings or weak points produced overall is also reduced, so that the cost of closing these weak points again is kept especially low.

BRIEF DESCRIPTION OF THE DRAWING

An exemplary embodiment of the invention is explained in more detail with reference to a drawing, in which.

DETAILED DESCRIPTION OF THE INVENTION

Figure 1:
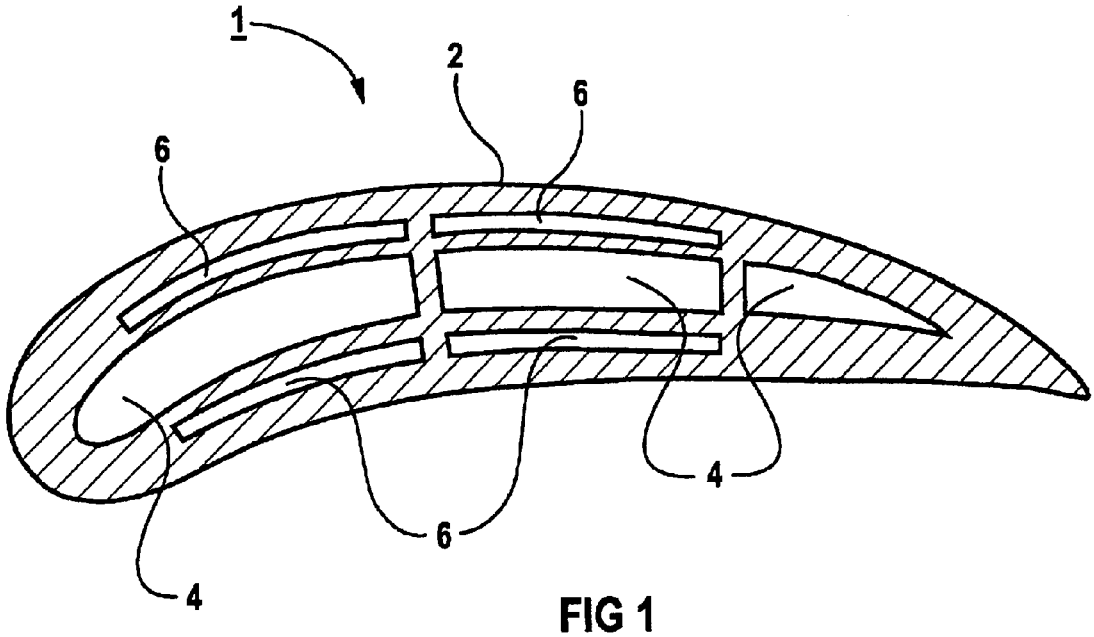
FIG. 1 shows a profiled turbine blade in cross section.

The same parts are provided with the same reference numerals in all the figures.

The turbine blade 1, which is shown in FIG. 1 in cross section, is intended for use in a gas turbine (not shown in any more detail). The turbine blade 1 comprises a blade body 2 extended along a blade axis and also designated as blade profile. As can be seen in FIG. 1, the blade body 2 is profiled or curved at its surface, so that especially favorable guidance of the working medium flowing through the gas turbine is ensured.

For thermodynamic reasons, the gas turbine is designed for a comparatively high outlet temperature of its working medium from the combustion chamber of, for example, 1200° C. to 1300° C. In order to also ensure high reliability and long service life of the respective components under these operating conditions, the turbine blade 1, in addition to other components, is also designed to be coolable. To this end, the blade body 2 comprises a number of integrated cavities 4, 6 which in each case serve as a flow passage for a cooling medium. In this case, the cavities 4 have a comparatively large cross section and serve as main flow path for the cooling medium. However, especially in the case of flow passages for the cooling medium which are to be kept comparatively large in cross section, a comparatively large wall thickness of the remaining structural parts of the turbine blade 1 is necessary for mechanical stabilization. On the other hand, it is attempted to keep the flow path of the cooling medium as close as possible to the top side of the turbine blade 1, which top side is exposed to hot gas. In order to also ensure this with high mechanical stability of the turbine blade 1, second cavities 6 are provided in addition to the first cavities 4 forming the main flow path for the cooling medium, these second cavities 6 running comparatively close below the surface of the turbine blade 1. These second cavities 6 form secondary passages for the cooling medium and communicate with the first cavities 4 on the inlet side and outlet side.

During the production of the turbine blade 1, a casting mold is used which has a cavity adapted to the desired outer contour of the turbine blade 1. To produce the cavities 4, 6, "core elements" adapted in their outer contour to the desired cavities 4 and 6, respectively, are positioned in this casting mold. The casting mold is then filled with blade material, the intended cavities 4 and 6, respectively, being kept free of blade material by the core elements. After the solidification of the blade material, the core elements are removed again, so that the desired cavities 4 and 6, respectively, remain in the cast turbine blade 1.

Figure 2:
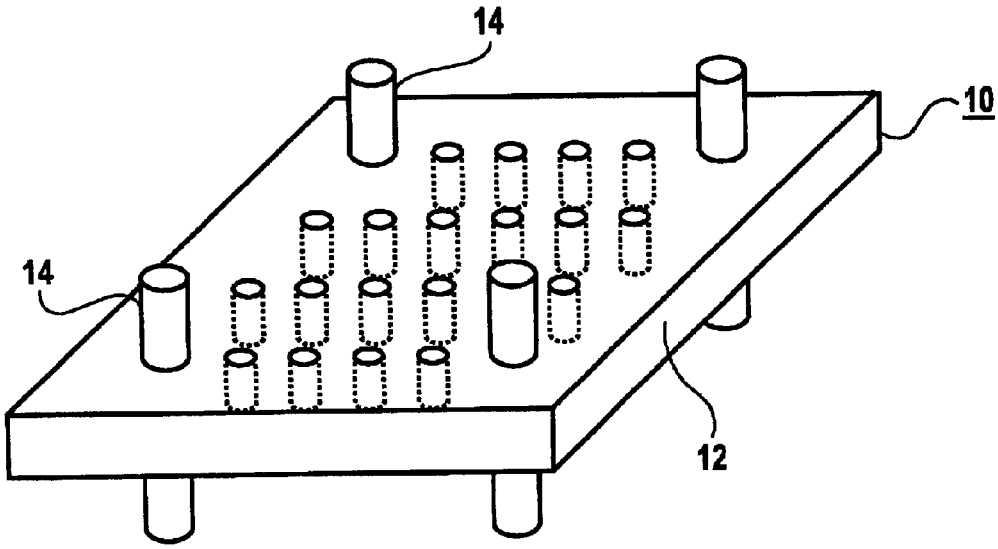
FIG. 2 shows a core element.

A core element 10 provided for producing one of the second cavities 6 is shown in FIG. 2. The core element 10 comprises a base plate 12 which is adapted in its shape to the contour desired for the respective cavity 6. In addition, a number of spacers 14 are arranged on the base plate 12 for the spatial positioning and fixing of the core element 10 during the casting operation.

In this case, each spacer 14 is of essentially cylindrical configuration and is designed in its length in such a way that it completely passes through the blade profile provided in its spatial region. In the exemplary embodiment, the spacers 14 are therefore designed in their length in such a way that they exceed the thickness of the material walls surrounding the respective cavity 6. In this case, the spacers 14 are each anchored with their free ends in the casting mold or in an adjacent core element, so that an essentially robust structure is also obtained during the casting operation.

After the casting operation and the solidification of the blade material, the blade body cast in this way has continuous openings at those points at which the spacers 14 were located. These openings can therefore easily be recognized and can therefore be subjected to a further treatment. In this case, the openings remaining in the turbine blade 1 after the removal of the core elements and the spacers and produced by the spacers 14 are closed by suitable stopper elements, as shown for a few different types of stopper elements in FIG. 3.

Figure 3:
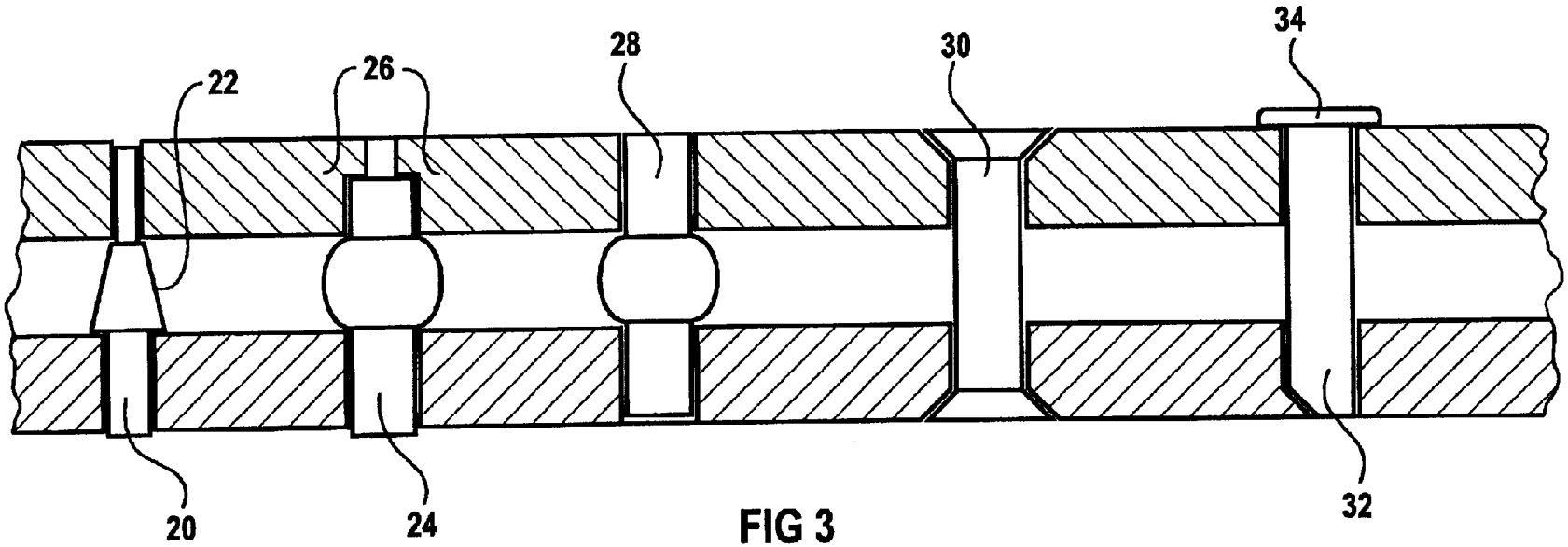
FIG. 3 shows a number of stopper elements in different embodiments.

FIG. 3, in the form of several alternative exemplary embodiments, shows a number of different stopper elements with which the openings left by the spacers 14 can be closed. In this case, the stopper element provided for the respective opening may be a drive-in pin 20 which comprises a conical shaped piece 22 like a barb in its center region. Alternatively, a drive-in pin 24 pressed or upset on one side may be provided, this drive-in pin 24 being especially suitable for the case in which the opening to be closed still has, on one side, projections 26 defining the actual opening passage. If there is a completely continuous opening, however, a continuous pin 28 may also be provided, this continuous pin 28 having been pressed or upset on both sides after it has penetrated into the respective opening. It is precisely due to the upsetting that an especially good sealing effect occurs in this case as a result of the thickening in the center region of the pin 28.

Alternatively, a pin 30 inserted into a continuous opening may also be used, the respective opening having bevels in its end regions. If the pin 30 is upset, it is deformed in its end regions, in the course of which its pin material adapts itself to the corresponding bevels of the respective openings. Furthermore, it is also possible to use a pin 32 which is tightly closed in its end region by applying a brazing cap 34 and by subsequent brazing.

It is to be understood that while certain forms of the invention have been illustrated and described, it is not to be limited to the specific forms or arrangement of parts herein described and shown. It will be apparent to those skilled in the art that various, including modifications, rearrangements and substitutions, may be made without departing from the scope of this invention and the invention is not to be considered limited to what is shown in the drawings and described in the specification. The scope if the invention is defined by the claims appended hereto.

What is claimed is:

1. A method of producing a turbine blade in hollow section, comprising the steps of:

a) providing a casting mold;

b) providing at least one core element;

c) inserting said at least one core element into said casting mold;

d) penetrating the core element with at least one approximately cylindrical spacer, longitudinally dimensioned so that an end projects beyond the blade profile produced and radially dimensioned with a sufficiently large size to easily detect cavities after the removal of the spacer;

e) positioning said at least one core elements within said casting mold via said at least one spacer, thereby forming at least one cavity within said casting mold;

f) providing a predetermined quantity of blade material within said at least one cavity;

g) removing said at least one core element and said at least one spacer from said blade material, whereby each spacer forms a pair of opposing openings within an outer wall and an adjacent inner wall of said blade material;

h) providing one stopper element for each pair of openings for closing said pair of openings; and i) closing said each pair of openings with said one stopper.

2. The method as claimed in claim 1, further comprising the step of forcing said at least one stopper element into an intimate orientation with said at least one opening.

3. The method as claimed in claim 1, in which said at least one stopper element is brazed into a substantially fixed relationship with respect to a corresponding at least one of said openings.

4. The method as claimed in claim 1, in which said at least one stopper element is a rivet.

5. The method as claimed in claim 1, in which said at least one stopper element is a drive-in pin.

6. The method as claimed in claim 1, wherein at least two spacers are arranged on opposite sides of the core element, whereby the two spacers are aligned to one another.

7. The method as claimed in claim 1, wherein the cylindrical shape of the at least one spacer gives direction to an axis on which at least one other spacer is arranged.

8. The method as claimed in claim 1, wherein the stopper element is inserted after casting.

9. The method as claimed in claim 1, wherein the outer wall is on a suction side.

10. The method as claimed in claim 1, wherein the outer wall is on a pressure side.

11. A method of producing a turbine blade in hollow section, comprising the steps of:

a) providing a casting mold;

b) providing a core element;

c) inserting said core element into said casting mold;

d) providing a substantially cylindrical spacer, that extends through the core element and is longitudinally dimensioned so that an end projects beyond the blade profile, the spacer radially sized and dimensioned with a sufficiently large size to easily detect cavities after the removal of the spacer;

e) positioning said core element within said casting mold via said spacer, thereby forming a cavity within said casting mold;

f) providing a predetermined quantity of blade material within said cavity;

g) removing said core element and said spacer from said blade material, thereby each spacer causing opposing openings within an outer wall and an adjacent inner wall of said blade material;

h) providing a stopper element for closing said opposite openings; and i) closing said openings with said stopper after casting.

12. The method as claimed in claim 11, in which a plurality of core elements are used.

13. The method as claimed in claim 12, in which a plurality of spacers are used.

14. A method of producing a turbine blade in hollow section, comprising the steps of:

a) providing a casting mold;

b) providing at least one core element;

c) inserting said at least one core element into said casting mold;

d) providing at least two approximately cylindrical spacer, which are arranged on opposite sides of the core element;

e) positioning said at least one core elements within said casting mold via said at least two spacer, thereby forming at least one cavity within said casting mold;

f) providing a predetermined quantity of blade material within said at least one cavity, g) removing said at least one core element and said at least two spacers from said blade material, thereby the spacers forming a pair of opposing openings within an outer wall and an adjacent inner wall of said blade material;

h) providing one stopper element for the pair of openings for closing the openings; and i) closing the pair of openings with said one stopper.

15. The method as claimed in claim 14, wherein for each pair of openings only one stopper is used.

16. The method as claimed in claim 14, wherein at least two spacers are arranged on opposite sides of the core element, whereby the two spacers are aligned to one another.

17. The method as claimed in claim 16, wherein the alignment is defined by the center axis of the spacer's cylindrical shape.

18. The method as claimed in claim 14, wherein the stopper element is inserted after casting.

19. The method as claimed in claim 14, wherein the spacers are longitudinally dimensioned and radially dimensioned with a sufficiently large size to easily detect cavities after the removal of the spacers.

* * * * *